US008376526B2

(12) United States Patent
Hara et al.

(10) Patent No.: US 8,376,526 B2
(45) Date of Patent: Feb. 19, 2013

(54) INKJET HEAD

(75) Inventors: Koichiro Hara, Nagoya (JP); Atsushi Ito, Nagoya (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 1434 days.

(21) Appl. No.: 11/716,251

(22) Filed: Mar. 9, 2007

(65) Prior Publication Data

US 2007/0285472 A1 Dec. 13, 2007

(30) Foreign Application Priority Data

Mar. 9, 2006 (JP) ..... 2006-064382
Mar. 9, 2006 (JP) ..... 2006-064383

(51) Int. Cl.
*B41J 2/045* (2006.01)

(52) U.S. Cl. ..... 347/68; 347/71

(58) Field of Classification Search ..... 347/68, 347/71

See application file for complete search history.

(56) References Cited

U.S. PATENT DOCUMENTS

| | | | | |
|---|---|---|---|---|
| 6,827,423 | B1 | 12/2004 | Katakura et al. | |
| 7,255,412 | B2 * | 8/2007 | Nagashima | 347/15 |
| 2003/0210307 | A1 | 11/2003 | Ito et al. | |

FOREIGN PATENT DOCUMENTS

| | | |
|---|---|---|
| JP | 10202919 | 8/1998 |
| JP | 2001315324 | 11/2001 |
| JP | 2002-011872 | 1/2002 |
| JP | 2003-326702 | 11/2003 |

OTHER PUBLICATIONS

Japanese Office Action (Decision of Refusal) for Japanese Patent Application No. 2006-064382 dated Sep. 18, 2012.

* cited by examiner

*Primary Examiner* — Kevin S Wood
(74) *Attorney, Agent, or Firm* — Frommer Lawrence & Haug LLP

(57) ABSTRACT

An inkjet head includes: a first nozzle that jets pigmented ink; a first pressure chamber coupled to the first nozzle; a first actuator that selectively applies a jetting pressure to the pigmented ink in the first pressure chamber; a second nozzle that jets dye ink; a second pressure chamber coupled to the second nozzle; and a second actuator that selectively applies a jetting pressure to the dye ink in the second pressure chamber. The first nozzle has a diameter D1 and the second nozzle D2. The first actuator has a first portion that applies the jetting pressure to the first pressure chamber, which has a size L1. The second actuator has a second portion that applies jetting pressure to the second pressure chamber, which has a size of L2. D1, D2, L1 and L2 satisfy the following formula: $-xD1+yL1 \approx -xD2+yL2$, where x and y are predetermined coefficients.

5 Claims, 10 Drawing Sheets

FIG. 5

| NOZZLE DIAMETER (μm) | PRESSURE CHAMBER LENGTH (mm) | AL (μs) |
|---|---|---|
| 16.0 | 1.12 | 4.2 |
| 17.0 | 1.12 | 4.2 |
| 18.0 | 1.12 | 4.1-4.2 |
| 19.0 | 1.12 | 4.2 |
| 19.5 | 1.42 | 4.1 |
| 20.5 | 1.42 | 4.1 |
| 21.5 | 1.42 | 4.1 |

FIG. 8

PRESSURE CHAMBER LENGTH: 1.42mm

| 24 | NARROW | 82 | ϕ | 19.5 |
|---|---|---|---|---|
| B/A | 2.4 | 2.8 | 3.1 | 3.5 |
| 0.5 | ○ | ○ | ○ | ○ |
| 0.8 | ○ | ○ | ○ | ○ |
| 1.0 | ○ | ○ | ○ | ○ |
| 1.3 | ○ | ○ | ○ | ○ |
| 1.5 | ○ | ○ | ○ | × |
| 1.8 | ○ | ○ | ○ | × |
| 2.0 | ○ | ○ | × | × |

| 19 | NARROW | 86 | ϕ | 19.5 |
|---|---|---|---|---|
| B/A | 2.4 | 2.8 | 3.1 | 3.5 |
| 0.5 | ○ | ○ | ○ | ○ |
| 0.8 | ○ | ○ | ○ | ○ |
| 1.0 | ○ | ○ | ○ | ○ |
| 1.3 | ○ | ○ | ○ | × |
| 1.5 | ○ | ○ | ○ | × |
| 1.8 | ○ | × | × | × |
| 2.0 | × | × | × | × |

| 14 | NARROW | 90 | ϕ | 19.5 |
|---|---|---|---|---|
| B/A | 2.4 | 2.8 | 3.1 | 3.5 |
| 0.5 | ○ | ○ | ○ | ○ |
| 0.8 | ○ | ○ | ○ | × |
| 1.0 | ○ | ○ | ○ | × |
| 1.3 | ○ | ○ | × | × |
| 1.5 | ○ | ○ | × | × |
| 1.8 | × | × | × | × |
| 2.0 | × | × | × | × |

| 22 | NARROW | 82 | ϕ | 20.5 |
|---|---|---|---|---|
| B/A | 2.4 | 2.8 | 3.1 | 3.5 |
| 0.5 | ○ | ○ | ○ | ○ |
| 0.8 | ○ | ○ | ○ | ○ |
| 1.0 | ○ | ○ | ○ | ○ |
| 1.3 | ○ | ○ | ○ | ○ |
| 1.5 | ○ | ○ | ○ | × |
| 1.8 | ○ | ○ | × | × |
| 2.0 | ○ | × | × | × |

| 19 | NARROW | 86 | ϕ | 20.5 |
|---|---|---|---|---|
| B/A | 2.4 | 2.8 | 3.1 | 3.5 |
| 0.5 | ○ | ○ | ○ | ○ |
| 0.8 | ○ | ○ | ○ | ○ |
| 1.0 | ○ | ○ | ○ | ○ |
| 1.3 | ○ | ○ | ○ | × |
| 1.5 | ○ | ○ | × | × |
| 1.8 | ○ | × | × | × |
| 2.0 | ○ | × | × | × |

| 14 | NARROW | 90 | ϕ | 20.5 |
|---|---|---|---|---|
| B/A | 2.4 | 2.8 | 3.1 | 3.5 |
| 0.5 | ○ | ○ | ○ | ○ |
| 0.8 | ○ | ○ | ○ | ○ |
| 1.0 | ○ | ○ | ○ | × |
| 1.3 | ○ | ○ | × | × |
| 1.5 | ○ | × | × | × |
| 1.8 | × | × | × | × |
| 2.0 | × | × | × | × |

| 22 | NARROW | 82 | ϕ | 21.5 |
|---|---|---|---|---|
| B/A | 2.4 | 2.8 | 3.1 | 3.5 |
| 0.5 | ○ | ○ | ○ | ○ |
| 0.8 | ○ | ○ | ○ | ○ |
| 1.0 | ○ | ○ | ○ | ○ |
| 1.3 | ○ | ○ | ○ | ○ |
| 1.5 | ○ | ○ | ○ | × |
| 1.8 | ○ | ○ | × | × |
| 2.0 | ○ | × | × | × |

| 18 | NARROW | 86 | ϕ | 21.5 |
|---|---|---|---|---|
| B/A | 2.4 | 2.8 | 3.1 | 3.5 |
| 0.5 | ○ | ○ | ○ | ○ |
| 0.8 | ○ | ○ | ○ | ○ |
| 1.0 | ○ | ○ | ○ | ○ |
| 1.3 | ○ | ○ | ○ | × |
| 1.5 | ○ | ○ | × | × |
| 1.8 | ○ | × | × | × |
| 2.0 | × | × | × | × |

| 13 | NARROW | 90 | ϕ | 21.5 |
|---|---|---|---|---|
| B/A | 2.4 | 2.8 | 3.1 | 3.5 |
| 0.5 | ○ | ○ | ○ | × |
| 0.8 | ○ | ○ | ○ | × |
| 1.0 | ○ | ○ | ○ | × |
| 1.3 | ○ | ○ | ○ | × |
| 1.5 | ○ | × | × | × |
| 1.8 | × | × | × | × |
| 2.0 | × | × | × | × |

FIG. 9

PRESSURE CHAMBER LENGTH: 1.12mm

| 25 | NARROW | 82 | ϕ | 16.0 |
|---|---|---|---|---|
| B/A | 2.4 | 2.8 | 3.1 | 3.5 |
| 0.5 | ○ | ○ | ○ | ○ |
| 0.8 | ○ | ○ | ○ | ○ |
| 1.0 | ○ | ○ | ○ | ○ |
| 1.3 | ○ | ○ | ○ | ○ |
| 1.5 | ○ | ○ | ○ | ○ |
| 1.8 | ○ | ○ | ○ | × |
| 2.0 | ○ | ○ | × | × |

| 20 | NARROW | 86 | ϕ | 16.0 |
|---|---|---|---|---|
| B/A | 2.4 | 2.8 | 3.1 | 3.5 |
| 0.5 | ○ | ○ | ○ | ○ |
| 0.8 | ○ | ○ | ○ | ○ |
| 1.0 | ○ | ○ | ○ | ○ |
| 1.3 | ○ | ○ | ○ | × |
| 1.5 | ○ | ○ | × | × |
| 1.8 | ○ | ○ | × | × |
| 2.0 | ○ | × | × | × |

| 14 | NARROW | 90 | ϕ | 16.0 |
|---|---|---|---|---|
| B/A | 2.4 | 2.8 | 3.1 | 3.5 |
| 0.5 | ○ | ○ | ○ | ○ |
| 0.8 | ○ | ○ | ○ | × |
| 1.0 | ○ | ○ | ○ | × |
| 1.3 | ○ | ○ | × | × |
| 1.5 | ○ | × | × | × |
| 1.8 | ○ | × | × | × |
| 2.0 | × | × | × | × |

| 23 | NARROW | 82 | ϕ | 17.0 |
|---|---|---|---|---|
| B/A | 2.4 | 2.8 | 3.1 | 3.5 |
| 0.5 | ○ | ○ | ○ | ○ |
| 0.8 | ○ | ○ | ○ | ○ |
| 1.0 | ○ | ○ | ○ | ○ |
| 1.3 | ○ | ○ | ○ | ○ |
| 1.5 | ○ | ○ | ○ | ○ |
| 1.8 | ○ | ○ | × | × |
| 2.0 | ○ | × | × | × |

| 19 | NARROW | 86 | ϕ | 17.0 |
|---|---|---|---|---|
| B/A | 2.4 | 2.8 | 3.1 | 3.5 |
| 0.5 | ○ | ○ | ○ | ○ |
| 0.8 | ○ | ○ | ○ | ○ |
| 1.0 | ○ | ○ | ○ | ○ |
| 1.3 | ○ | ○ | ○ | × |
| 1.5 | ○ | ○ | × | × |
| 1.8 | ○ | × | × | × |
| 2.0 | ○ | × | × | × |

| 13 | NARROW | 90 | ϕ | 17.0 |
|---|---|---|---|---|
| B/A | 2.4 | 2.8 | 3.1 | 3.5 |
| 0.5 | ○ | ○ | ○ | ○ |
| 0.8 | ○ | ○ | ○ | × |
| 1.0 | ○ | ○ | × | × |
| 1.3 | ○ | ○ | × | × |
| 1.5 | ○ | × | × | × |
| 1.8 | ○ | × | × | × |
| 2.0 | × | × | × | × |

| 23 | NARROW | 82 | ϕ | 18.0 |
|---|---|---|---|---|
| B/A | 2.4 | 2.8 | 3.1 | 3.5 |
| 0.5 | ○ | ○ | ○ | ○ |
| 0.8 | ○ | ○ | ○ | ○ |
| 1.0 | ○ | ○ | ○ | ○ |
| 1.3 | ○ | ○ | ○ | ○ |
| 1.5 | ○ | ○ | ○ | ○ |
| 1.8 | ○ | ○ | × | × |
| 2.0 | ○ | × | × | × |

| 18 | NARROW | 86 | ϕ | 18.0 |
|---|---|---|---|---|
| B/A | 2.4 | 2.8 | 3.1 | 3.5 |
| 0.5 | ○ | ○ | ○ | ○ |
| 0.8 | ○ | ○ | ○ | ○ |
| 1.0 | ○ | ○ | ○ | ○ |
| 1.3 | ○ | ○ | ○ | × |
| 1.5 | ○ | ○ | × | × |
| 1.8 | ○ | × | × | × |
| 2.0 | × | × | × | × |

| 12 | NARROW | 90 | ϕ | 18.0 |
|---|---|---|---|---|
| B/A | 2.4 | 2.8 | 3.1 | 3.5 |
| 0.5 | ○ | ○ | ○ | ○ |
| 0.8 | ○ | ○ | ○ | × |
| 1.0 | ○ | ○ | × | × |
| 1.3 | ○ | ○ | × | × |
| 1.5 | ○ | × | × | × |
| 1.8 | × | × | × | × |
| 2.0 | × | × | × | × |

INKJET HEAD

CROSS-REFERENCE TO RELATED APPLICATIONS

The entire disclosures of Japanese Patent Application No. 2006-064382 filed on Mar. 9, 2006 and Japanese Patent Application No. 2006-064383 filed on Mar. 9, 2006 including specifications, claims, drawings and abstracts are incorporated herein by reference in their entirety.

BACKGROUND

1. Field

The present invention relates to an inkjet head that has nozzles for jetting ink drops, pressure chambers coupled to the nozzles, and actuators selectively applying a jetting pressure to the ink in the pressure chambers, and performs recording by using pigmented ink and dye ink.

2. Description of the Related Art

To meet recent demands for higher recording quality, there have been proposed inkjet heads which perform recording with pigmented ink and dye ink. In order to record high-quality images having high contrast, such proposed inkjet heads use a pigmented ink as black ink and use dye inks, which are vivid in color, as color inks other than black ink.

Because pigmented ink is less spreadable on a recording medium than dye ink, the volume of the ink drops of the pigmented ink jetted from the nozzles for recording one dot needs to be larger than that of the dye ink, to obtain the same resolution.

In such an inkjet recording apparatus, driving voltage waveforms of different pulse numbers may be used between when pigmented ink is jetted and when dye ink is jetted so that the number of drops of pigmented ink jetted for the recording of one dot is larger than that of the dye ink (See JP-A-2001-315324).

Apart from that, there has been proposed a method in which the length of the flow paths, from the pressure chambers to the nozzles, for the black ink is made different from that of the flow paths for the color inks, to thereby enlarge the drop gradation range.

SUMMARY

However, when the ink drop volume is changed by the driving voltage waveforms having different pulse numbers, it is necessary to use various kinds of driving voltage waveforms. Thus, the control of the ink drop jetting may be complicated. On the other hand, when the flow path lengths are different for black ink and color inks, the cycles of fluctuating pressure waves occurring in the pressure chambers caused by the pressure on the ink by the actuators may be different. Then, it is necessary to provide different driving voltage waveforms for black ink and for color inks, so that the control of the ink drop jetting may be complicated.

Accordingly, one embodiment of the present invention provides an inkjet head that performs recording with pigmented ink and dye ink, while facilitating the control of the ink drop jetting.

According to one embodiment of the invention, an inkjet head includes: a first nozzle that jets pigmented ink; a first pressure chamber coupled to the first nozzle; a first actuator that selectively applies a jetting pressure to the pigmented ink in the first pressure chamber; a second nozzle that jets dye ink; a second pressure chamber coupled to the second nozzle; and a second actuator that selectively applies a jetting pressure to the dye ink in the second pressure chamber; wherein the first nozzle has a diameter of D1; the second nozzle has a diameter of D2; the first actuator has a first portion that applies jetting pressure to the first pressure chamber, the first portion having a size of L1; the second actuator has a second portion that applies jetting pressure to the second pressure chamber, the second portion having a size of L2; and D1, D2, L1 and L2 satisfy the following formula: $-xD1+yL1 \approx -xD2+yL2$, where x and y are predetermined coefficients.

According to another embodiment of the invention, an inkjet head including: a first common ink chamber that stores pigmented ink; a plurality of first pressure chambers each coupled to the first common ink chamber to store the pigmented ink supplied from the first common chamber; a plurality of first actuators each associated to respective one of the plurality of first pressure chambers, the plurality of first actuators selectively applying a jetting pressure on the pigmented ink in the plurality of first pressure chambers; a plurality of first nozzles each coupled to respective one of the plurality of first pressure chambers to jet the pigmented ink; a first narrow portion coupled between the first common ink chamber and the plurality of first pressure chambers to supply the pigmented ink from the first common ink chamber, the first narrow portion having a larger flow passage resistance than the first common ink chamber and the plurality of first pressure members; a second common ink chamber that stores dye ink; a plurality of second pressure chambers each coupled to the second common ink chamber to store the dye ink supplied from the second common chamber; a plurality of second actuators each associated to respective one of the plurality of second pressure chambers, the plurality of second actuators selectively applying a jetting pressure on the dye ink in the plurality of second pressure chambers; a plurality of second nozzles each coupled to respective one of the plurality of second pressure chambers to jet the dye ink; and a second narrow portion coupled between the second common ink chamber and the plurality of second pressure chambers to supply the dye ink from the second common ink chamber, the second narrow portion having a larger flow passage resistance than the second common ink chamber and the plurality of second pressure members; wherein the first pressure chamber has a length in a longitudinal direction thereof larger than a length of the second pressure chamber in a longitudinal direction thereof; and the first narrow portion and the second narrow portion are substantially the same in flow passage resistance.

BRIEF DESCRIPTION OF THE DRAWINGS

Embodiment may be described in detail with reference to the accompanying drawings, in which:

FIG. 5 is a table in which the measurement results are summarized;

FIG. 8 is a table in which the measurement results are summarized; and

FIG. 9 is a table in which the measurement results are summarized;

DETAILED DESCRIPTION

One embodiment of the present invention will be described with reference to the drawings.

[Principal Structure]

Figure 1:
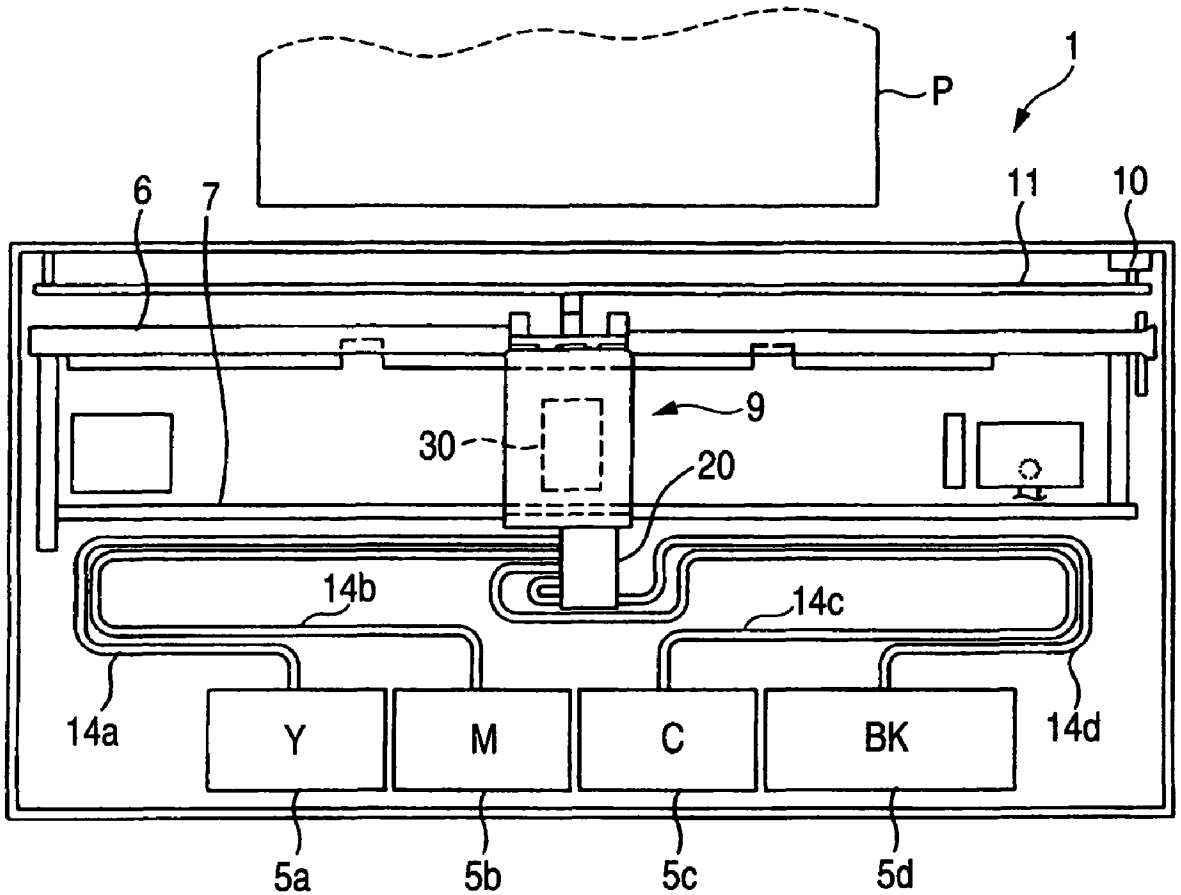
FIG. 1 is an explanatory plan view showing the principal structure of the inkjet recording apparatus.

First, the principal structure of an inkjet recording apparatus will be described with reference to FIG. 1. FIG. 1 is an explanatory plan view showing the principal structure of the inkjet recording apparatus.

Two guide shafts 6 and 7 are provided inside the inkjet recording apparatus 1. A head holder 9 that also functions as a carriage is attached to the guide shafts 6 and 7. The head holder 9 holds an inkjet head 30 that jets ink to a recording sheet of paper P to perform recording. The head holder 9 is attached to an endless belt 11 rotated by a carriage motor 10, and is moved along the guide shafts 6 and 7 by driving the carriage motor 10.

The inkjet recording apparatus 1 is provided with an ink tank 5*a* containing yellow ink, an ink tank 5*b* containing magenta ink, an ink tank 5*c* containing cyan ink, and an ink tank 5*d* containing black ink. The ink tanks 5*a* to 5*d* are respectively connected to flexible ink supply tubes 14*a*, 14*b*, 14*c*, and 14*d*, and the inks supplied from the ink supply tubes are directed into the inkjet head 30 via a tube joint 20 extending forward from the head holder 9. As the respective inks, pigmented ink or dye ink can be used.

[Structure of the Inkjet Head]

Next, the structure of the inkjet head 30 will be described with reference to FIGS. 2 and 3.

Figure 2:
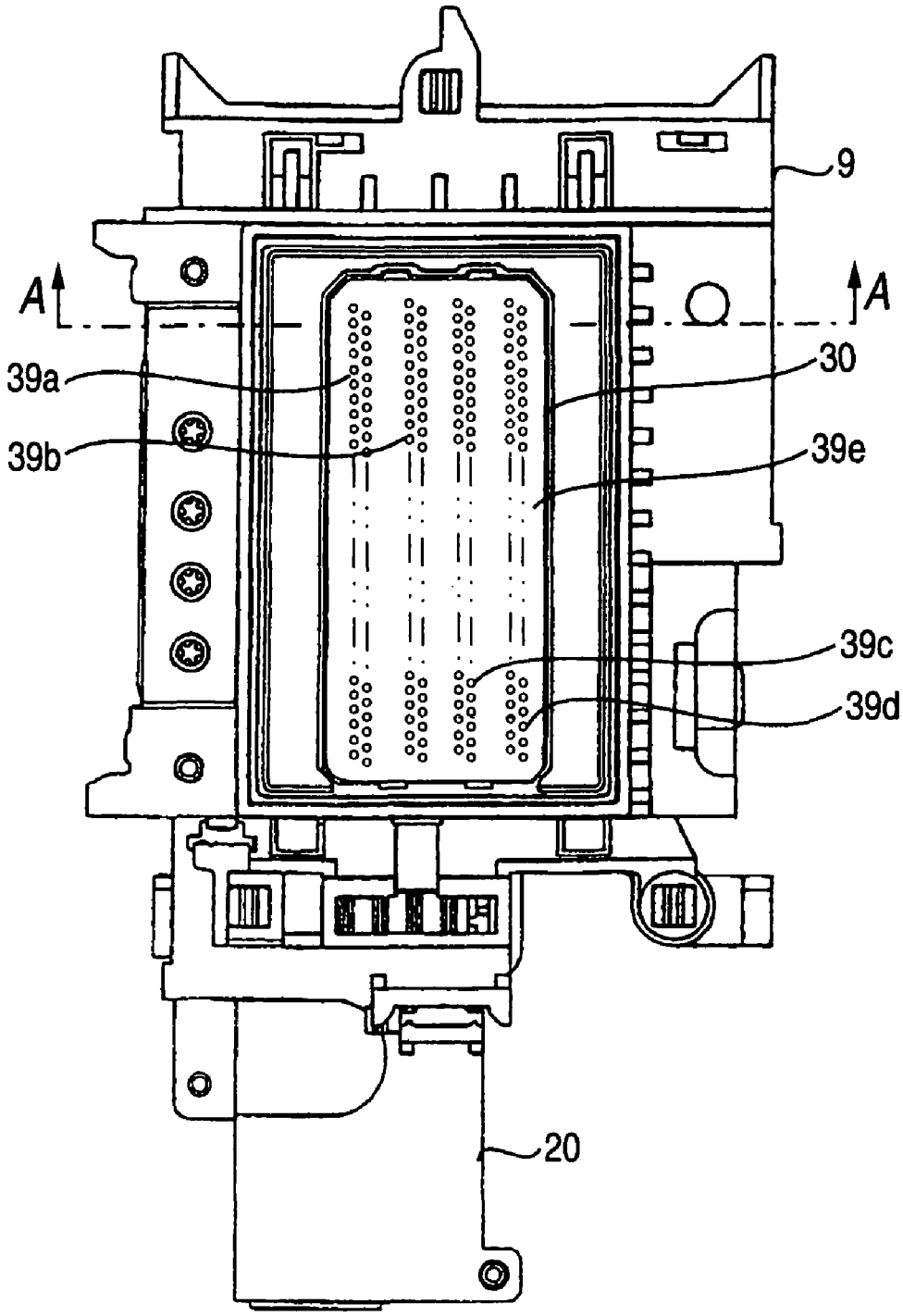
FIG. 2 is a plan view of a head holder observed from a nozzle surface.
Figure 3B:
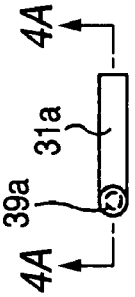
FIG. 3B is an explanatory plan view showing one of the pressure chambers shown in FIG. 3A.
Figure 3A:
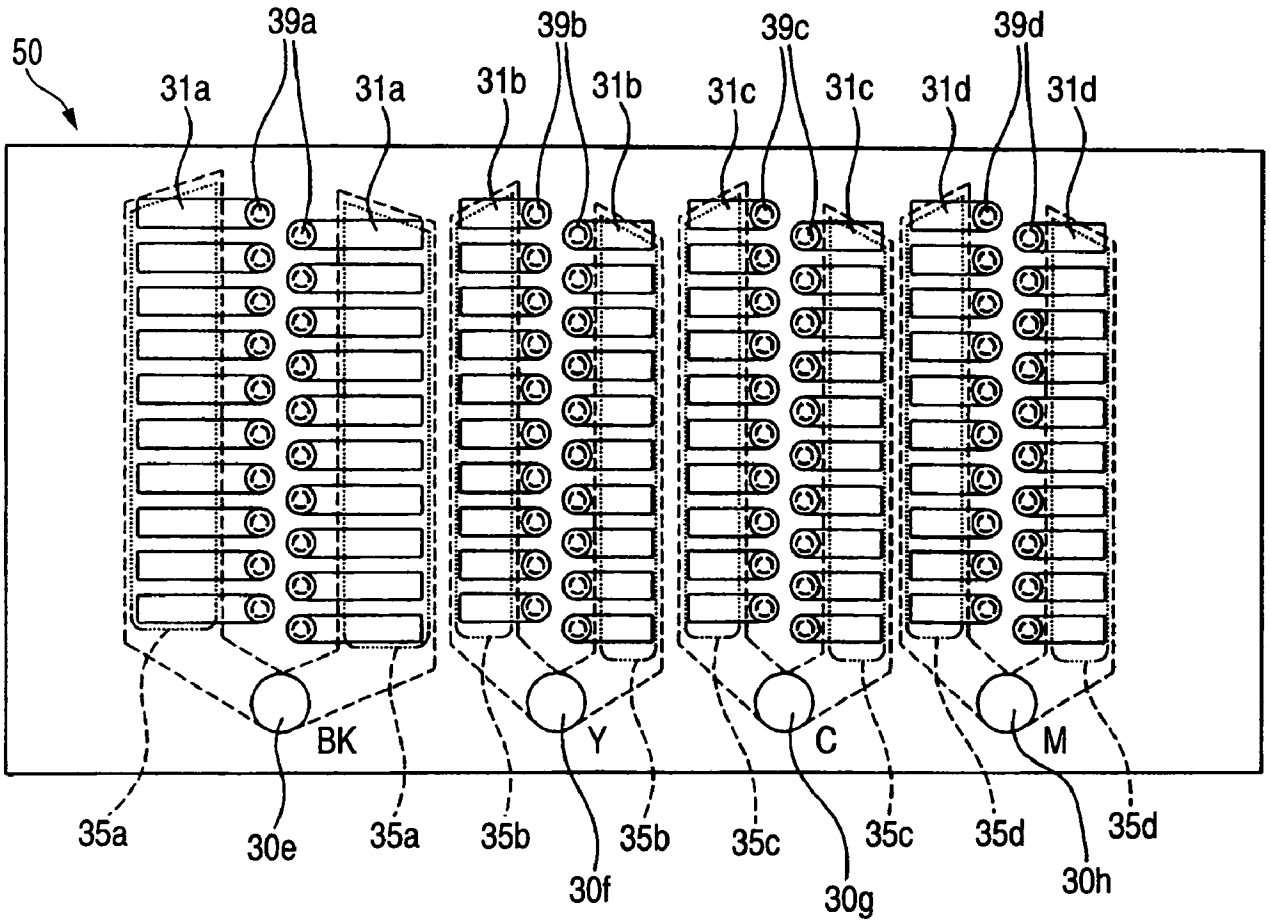
FIG. 3A is an explanatory plan view of pressure chambers inside an inkjet head held in the head holder shown in FIG. 2 observed from above.

FIG. 2 is a plan view of the head holder 9 observed from the nozzle surface. FIG. 3A is an explanatory plan view of pressure chambers inside the inkjet head held by the head holder 9 shown in FIG. 2 observed from above, and FIG. 3B is an explanatory plan view showing one of the pressure chambers shown in FIG. 3A. In the following description, ink drops are jetted in downward direction.

As shown in FIG. 2, two rows of nozzles 39*a* that jet black ink, two rows of nozzles 39*b* that jet yellow ink, two rows of nozzles 39*c* that jet cyan ink, and two rows of nozzles 39*d* that jet magenta ink are respectively arranged on a nozzle surface 39*e*, which is formed on the lower surface of the inkjet head 30. Each two rows of nozzles extend in a direction perpendicular to a movement direction (main scanning direction) of the head holder 9. The respective nozzles are opened downward to face on an upper surface of the recording sheet of paper P (FIG. 1), which serves as a recording medium.

As shown in FIG. 3A, the inkjet head 30 is configured by a cavity plate 31 in which a plurality of pressure chambers 31*a* to 31*d* are arranged in a matrix manner in a relative movement direction of the inkjet head 30 with respect to the recording sheet (hereinafter, referred to as main scanning direction) and a direction perpendicular thereto (hereinafter, referred to as sub scanning direction). Eight rows of pressure chambers are arranged in the main scanning direction of the inkjet head 30, and each row is configured by a multiplicity of pressure chambers (ten of them are shown and the others are omitted in the drawing) arranged in the sub scanning direction of the inkjet head 30.

The pressure chambers 31*a* in the left two rows stores pigmented black ink supplied from an ink supply port 30*e*. The pressure chambers 31*b* in the third and fourth rows from the left contain dye yellow ink supplied from an ink supply port 30*f*. The pressure chambers 31*c* in the fifth and sixth rows from the left stores dye cyan ink supplied from an ink supply port 30*g*. The pressure chambers 31*d* in the right two rows contain dye magenta ink supplied from an ink supply port 30*h*.

In the respective rows of the nozzles 39*a* to 39*d* for jetting the inks in the pressure chambers as ink drops, the nozzles for jetting ink drops of the same color are arranged in a staggered configuration. The intervals at which the nozzles are arranged in the sub scanning direction are determined based on the resolution in the specifications of the inkjet head.

Next, the longitudinal section structure of the inkjet head 30 will be described with the part corresponding to the pressure chambers 31*a* that jet black ink as an example.

Figure 4A:
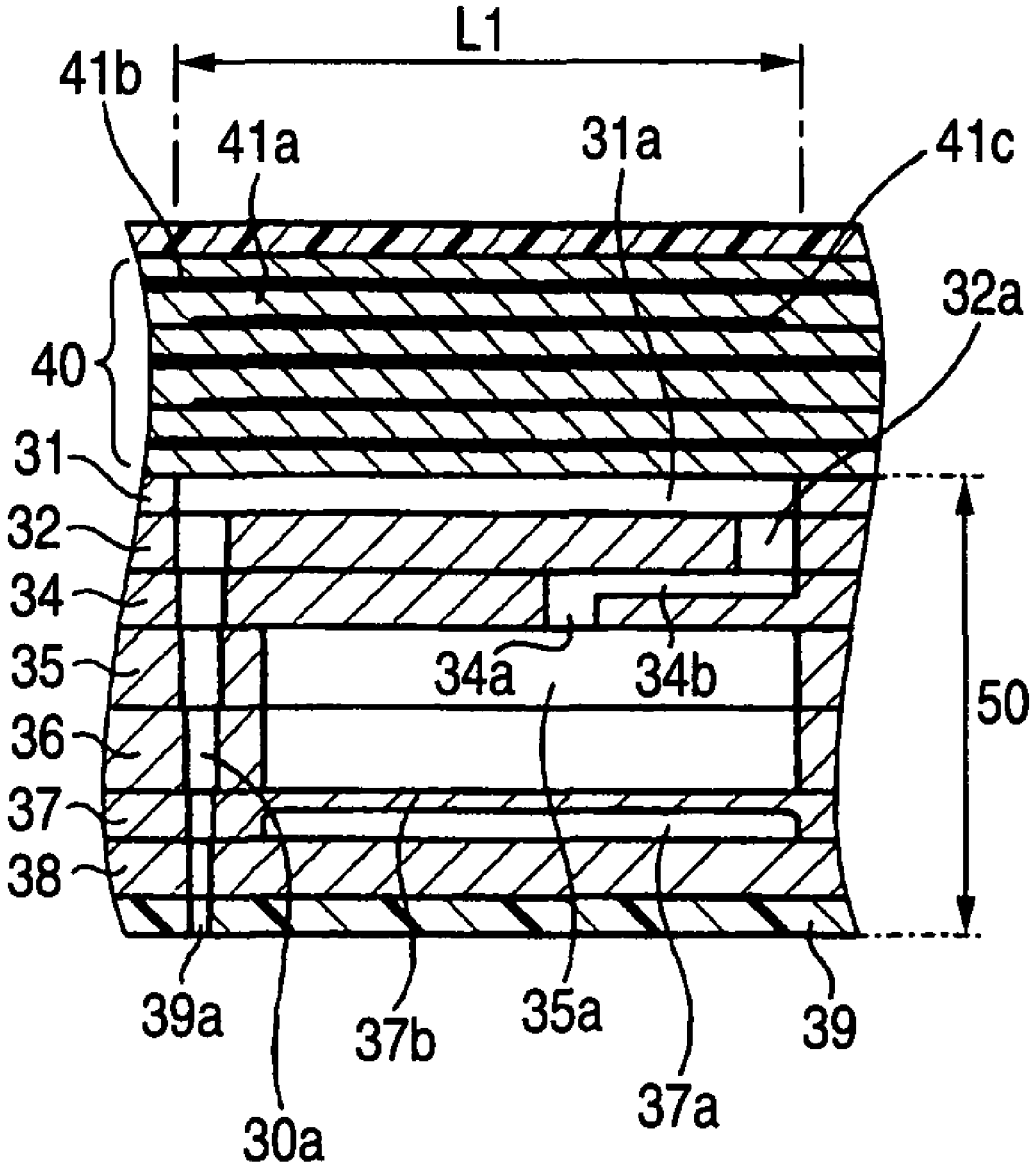
FIG. 4A is a cross sectional view viewed along arrows 4A-4A in FIG. 3B, showing a part of cross section of the inkjet head when the part of the pressure chambers that jet black ink drops is longitudinally cut in the length direction.
Figure 4B:
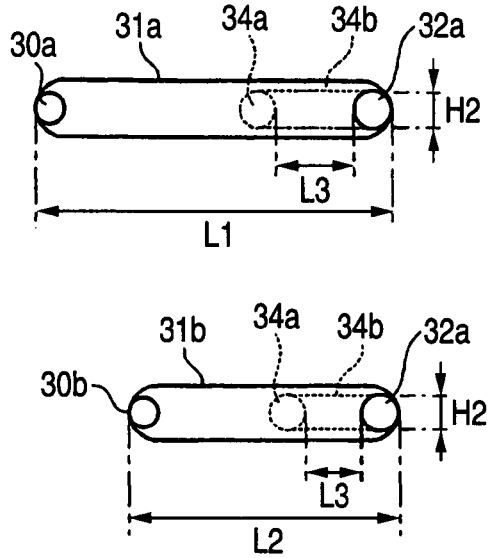
FIG. 4B is an explanatory plan view of the pressure chambers and the narrow portions.
Figure 4C:
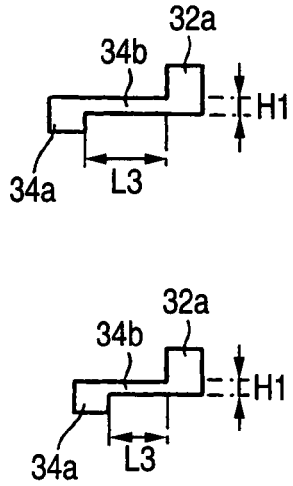
FIG. 4C is an explanatory longitudinal cross-sectional view of the narrow portions.
Figure 4D:
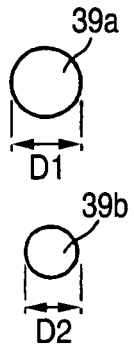
FIG. 4D is an explanatory view of the nozzle diameters.

FIG. 4A is a cross-sectional view viewed along the arrows 4A-4A in FIG. 3B, showing a part of the cross section of the inkjet head 30 when the part of the pressure chambers 31*a* that jet black ink drops is longitudinally cut in the length direction. FIG. 4B is an explanatory plan view of the pressure chambers and narrow portions, FIG. 4C is an explanatory longitudinal cross-sectional view of the narrow portions, and FIG. 4D is an explanatory view of nozzle diameters.

As shown in FIG. 4A, the inkjet head 30 includes a piezoelectric actuator 40 bonded to the upper surface of a cavity unit 50. The cavity unit 50 has a structure such that a total of eight thin plates of a nozzle plate 39, a spacer plate 38, a damper plate 37, manifold plates 36 and 35, a supply plate 34, a base plate 32, and the cavity plate 31 from below are placed one on another and bonded together. To the bonding of the plates and the bonding of the cavity unit 50 and the piezoelectric actuator 40, bonding means such as an adhesive agent is applicable.

In the cavity plate 31, a plurality of pressure chambers 31*a* are formed in a groove shape so that the upper surfaces thereof are opened. In the manifold plates 36 and 35, common ink chambers 35*a* containing black ink supplied to the respective pressure chambers 31*a* are formed. In the supply plate 34, narrow portions 34*b* are formed. The narrow portions 34*b* are coupled with the common ink chambers 35*a* via communicating holes 34*a* formed so as to pass through the supply plate 34. On the supply plate 34, the base plate 32 is laminated so as to cover the openings in the length direction of the respective narrow portions 34*b*. In the base plate 32, communicating holes 32*a* coupled to the pressure chamber 31*a* are formed so as to pass therethrough, and the communicating holes 32*a* are coupled to the narrow portions 34*b* formed in the supply plate 34. That is, the pressure chambers 31*a* are connected to the common ink chambers 35*a* via the narrow portions 34*b*.

The longitudinal cross-sectional area of each narrow portion 34*b* is smaller than that of the pressure chamber with which the narrow portion 34*b* communicates, and the flow passage resistance thereof is set so as to be higher than those of the common ink chambers and the pressure chambers. Therefore, the respective narrow portions 34*b* relieve the component of the pressure fluctuations in the communicating pressure chambers, which propagates toward the common ink chambers. Consequently, when a pressure is applied to the ink in the pressure chambers 31*a* by the piezoelectric actuator 40, the flow of the black ink moving toward the nozzles 39*a* can be efficiently generated.

A damper chamber 37*a* is formed on the lower surface of the damper plate 37 disposed below each common ink chamber. The respective damper chambers 37*a* are open downwardly on the lower surface of the damper plate 37. The lateral cross-sectional configuration of the damper chambers 37*a* is the same as the lateral cross-sectional configuration of the lower surfaces of the common ink chambers adjacent to the damper plate 37.

The damper plate 37 is made of a material such as an elastically deformable metal, and thin-plate-form bottom plate portions 37*b* in upper parts of the damper chambers 37*a* can be freely vibrated both toward the common ink chambers 35*a* and toward the damper chambers 37*a*. The damper plate 37 has a damper effect as follows: Even when the pressure fluctuations in the pressure chambers 31*a* caused by jetting black ink drops are propagated to the common ink chambers, the bottom plate portions are elastically deformed and vibrated such that the pressure fluctuations are absorbed and attenuated. The damper plate 37 also produces an effect of preventing a crosstalk in which the pressure fluctuations are propagated to other pressure chambers.

In the plates 32 to 38 between the cavity plate 31 and the nozzle plate 39, through holes 30*a* for leading the black ink in the pressure chambers 31*a* to the nozzles 39*a* are formed in the vertical direction so as to be coupled with one another.

The piezoelectric actuator 40 includes a sheet-form piezoelectric material 41*a*, and sheet-form electrodes 41*b* and 41*c* alternately laminated one on another. The parts of the piezoelectric material sandwiched between the electrodes 41*b* and 41*c* functions as active parts 41*a*. By applying a voltage between the electrodes 41*b* and 41*c*, the active parts 41*a* are elongated in the direction of the lamination to exert a jetting pressure to the ink in the pressure chambers 31*a*. The active parts are correspondingly disposed above the respective pressure chambers 31*a*. While their plane area is smaller than the plane area of the respective pressure chambers 31*a* in a planar view, the surrounding piezoelectric material parts are also elongated as the active parts 41*a* are elongated. Accordingly, the areas of the parts where the pressure is applied to the pressure chambers 31*a* are the same as the plan area of the pressure chambers 31*a*, that is, the area of the openings in the upper surfaces of the pressure chambers. A pressure chamber length L1 described later is the length, in the direction of the ink flow, of the pressure chambers at the parts to which the pressure is applied.

Although the longitudinal cross-sectional structure of the pressure chambers containing color inks, etc., is the same as that of the above-described pressure chambers of black ink, etc., the sizes of the pressure chambers, the narrow portions and the nozzles are different. The difference will be explained with the pressure chambers containing yellow ink, etc., as an example. The pressure chamber length L1 of the pressure chambers 31*a* storing black ink is larger than that of the pressure chambers 31*b* storing yellow ink. Moreover, as shown in of FIG. 4B and FIG. 4C, with respect to the length L2 of the narrow portions 34*b* corresponding to the ink flow direction (hereinafter, referred to as narrow portion length), the length L2 of the narrow portions 34*b* on the black ink side is larger than that on the yellow ink side. Further, as shown in FIG. 4D, with respect to the nozzle diameter, the diameter D1 of the nozzles 39*a* that jet black ink drops is larger than the diameter D2 of the nozzles 39*b* that jet yellow ink drops.

That is, the volume of the black ink drops jetted from the nozzles is larger than that of the color ink drops.

The head holder 9 is provided with a relay tank (not shown) having relay ink chambers storing bubbles contained in the ink supplied from ink tanks 5*a* to 5*d* (FIG. 1), and to the ink supply ports (not shown) supplying ink to the common ink chambers, ink is supplied from the respective ink tanks 5*a* to 5*d* via the relay tanks.

First Experiment

Next, a first experiment performed by the inventors of the present application will be described.

The inventors of the present application performed an experiment to obtain the correlation that is present among the value of the natural period of the pressure wave caused in the ink in the pressure chambers by the operation of the actuator (hereinafter, explanation will be given with ½ this value as the AL value), the nozzle diameter D, and the pressure chamber length L.

The target value of the AL value was set to 4.2 (μs), and the AL value was measured while the nozzle diameter D1 was changed in a range of 16.0 μm to 21.5 μm and the pressure chamber length L was changed in a range of 1.12 mm to 1.42 mm. Moreover, by performing the same measurements on a plurality of heads of the same specifications, the manufacturing variations that are present among the heads were converged.

The width (the width in the direction perpendicular to the length L when observed two-dimensionally) of the pressure chambers 31*a* was fixed to 270 μm, the depth thereof (the thickness of the inkjet head 30), to 50 μm, the length of the narrow portions 34*b*, to 700 μm, the width thereof, to 80 μm, and the depth thereof, to 30 μm.

FIG. 5 is a table in which some of the measurement results are picked up and summarized. For example, it was found from the table that in order to realize that the AL value is 4.2 μs when the nozzle diameter D is the minimum value 16.0 μm, the pressure chambers are formed so that the chamber length L is 1.12 mm. It was also found that in order to realize that the AL value is the same value 4.2 us when the nozzle diameter D is the maximum value 21.5 μm, the pressure chambers are formed so that the pressure chamber length L is 1.42 mm.

Then, it was found from the measurement results that when the AL value is 4.2 μs, there is a correlation shown by the following expression among the AL value, the nozzle diameter D, and the pressure chamber length L:

$$4.2 \approx -0.09D+0.83L+4.73 \quad \text{(expression 1)}$$

Figure 6:
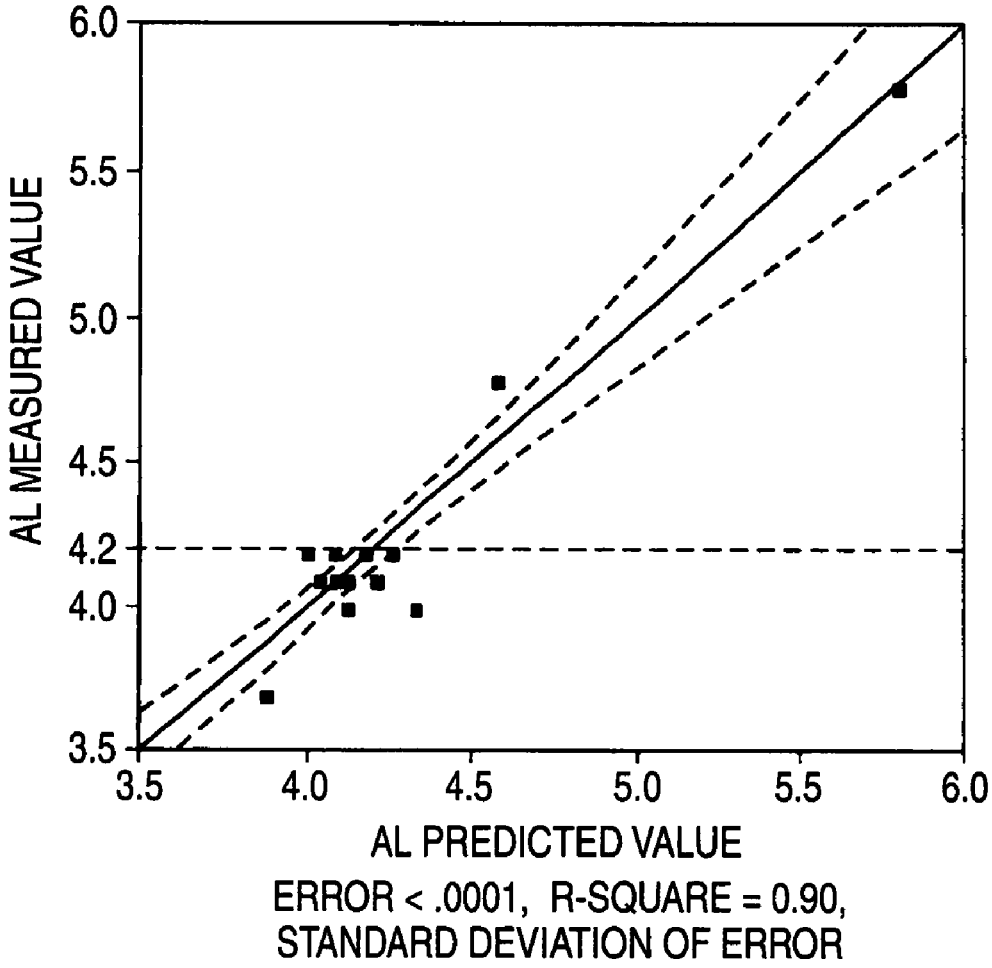
FIG. 6 is a graph showing the relationship between an AL actual measured value which is the actually measured AL value and the AL predicted value.

FIG. 6 is a graph showing the relationship between an AL actual measured value which is the actually measured AL value and an AL predicted value. The AL predicted value was calculated by using the following expression with the AL value 4.2 of the expression 1 as an unknown quantity and substituting the nozzle diameter D and the actual length L:

$$AL \approx -0.09D+0.83L+4.73 \quad \text{(expression 2)}$$

The graph shown by the solid line is a graph representing the expression 2, and the graphs shown by the broken lines are respectively 95% confidence lines. As is apparent from these graphs, the AL predicted value mostly coincides with the AL actual measurement value. That is, it is understood that the expression 2 is extremely high in reliability.

When the coefficients 0.09 and 0.83 of the nozzle diameter D and the actual length L of the expression 2 are replaced with coefficients x and y and the constant 4.73 is a constant z, the following expression 3 is obtained:

$$AL \approx -xD+yL+z \quad \text{(expression 3)}$$

That is, when the AL value is a constant value and the nozzle diameter D is changed, the pressure chamber length L to be set can be obtained by substituting the AL value and the nozzle diameter D into the above-described expression.

It is presumed that the AL value slightly differs between pigmented ink and dye ink because of the difference in ink property even when the nozzle diameter D and the actual length L are the same; however, since it is considered that the difference is within the range of measurement errors of the AL value, the expression 3 is applicable both when pigmented ink drops are jetted and when dye ink drops are jetted.

Therefore, when a group composed of nozzles, pressure chambers, and actuators using pigmented ink is a first group, a group including nozzles, pressure chambers, and actuators using dye ink is a second group, the nozzle diameter and the pressure chamber length of the first group are D1 and L1, respectively, and those of the second group are D2 and L2, respectively, the following expression 4 holds:

$$AL \approx -xD1+yL1+z \approx -xD2+yL2+z \quad \text{(expression 4)}$$

Subtracting the constant Z from the expression 4, the following expression 5 is obtained:

$$-xD1+yL1 \approx -xD2+yL2 \quad \text{(expression 5)}$$

That is, since the nozzle diameters D1 and D2 can be made different from each other (D1≠D2) by adjusting the pressure chamber lengths L1 and L2, the nozzle diameter D1 of the first group that jets pigmented ink drops can be made larger than the nozzle diameter D2 of the second group that jets dye ink drops.

The driving voltage waveform of the above-described inkjet head is used, for example, in a structure where the active parts are displaced by a so-called "fill before fire" method in which, after drawing ink into the pressure chamber by increasing a volume of the pressure chamber once, a substantial pressure is applied to the ink by returning the volume of the pressure chamber to its original volume. In such a structure, after the volume of the pressure chambers is increased to cause a pressure wave in ink, the volume of the pressure chamber is reduced when the pressure rises, thereby ink can be jetted efficiently. From the above-described experiment, even groups having different nozzle diameters and pressure chamber lengths can be driven by the same driving voltage waveform when the fluctuation cycles of the pressure wave are substantially the same. That is, in a structure in which the nozzle diameter D1 of black ink is larger than the nozzle diameter D2 of dye ink so that the volumes of the ink drops jetted from these are made different from each other, a common driving voltage waveform can be used for both.

Consequently, since the size of one dot recorded on the recording sheet of paper P can be made the same between black and colors, the recording quality can be improved. In addition, since the AL value can be made the same value between the two groups, a common driving voltage waveform can be used.

In the present embodiment, for example, the diameter D1 of the nozzles that jet black ink is 20 μm, the pressure chamber length L1 is 1.42 mm, the diameter D2 of the nozzles that jet color ink is 16 μm, and the pressure chamber length L2 is 1.12 mm.

Second Experiment

The inventors of the present application also performed an experiment with respect to the size of the narrow portions in groups having different nozzle diameters and pressure chamber lengths as described above, that is, the flow passage resistance. In this experiment, with a pressure chamber length L1=1.42 mm and a pressure chamber length L2=1.12 mm (the width and the depth are as mentioned above), the nozzle diameter, the narrow portion diameter L3, the narrow portion size, and the driving voltage waveform were changed, and the recording quality was evaluated for each.

Figure 7:
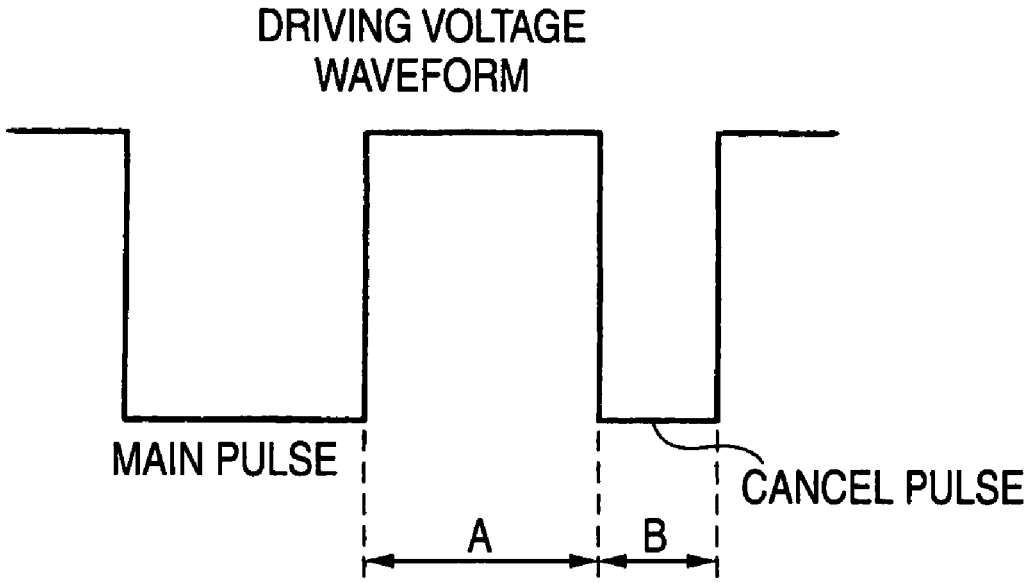
FIG. 7 is an explanatory view showing the driving voltage waveform applied to the piezoelectric actuator.

FIG. 7 is an explanatory view showing the driving voltage waveform applied to the piezoelectric actuator. The main pulse is the principal driving voltage waveform applied to the piezoelectric actuator for jetting ink drops, and the cancel pulse is the driving voltage waveform applied to the piezoelectric actuator for canceling the residual voltage fluctuations caused in the pressure chambers when ink drops are jetted.

In the waveform of FIG. 7, when no ink drops are jetted, a voltage (22 V) is applied to elongate the active portions so that the volume of the pressure chambers is reduced, when ink drops are jetted, the application of the voltage is selectively stopped (the main pulse falls) to increase the volume of the pressure chambers, and after a predetermined period of time, the voltage is applied again (the main pulse rises) and the jetting pressure is applied to the ink in the pressure chambers. The pulse width from the fall to the rise of the main pulse is selected from among values close to ½ the natural period of the ink in the pressure chambers, that is, the AL value.

In this experiment, the pulse width of the main pulse when AL=4.2 μs in the first experiment was 4.0 μs and the pulse width B of the cancel pulse was 0.5 to 2.0 μs, and the experiment was performed while the interval A between the main pulse and the cancel pulse was changed within a range of 2.4 to 3.5 μs.

With respect to the narrow portions, the length L3=700 μm, the width H2 was changed in a range of 82 μm, 86 μm, and 90 μm, the aspect ratio (the width H2/the depth H1) was fixed to 2.7, and the depth H1 was changed according to the width H2.

The change range of the nozzle diameter D was 16 to 21.5 μm. The ambient temperature when the experiment was performed was 25° C., the viscosity of the actually used ink was 2 to 5 cps, the driving frequency of the inkjet head was 20 to 40 kHz, and the ink drop jetting speed was 5 to 15 m/s.

FIGS. 8 and 9 are tables in which the experimental results are summarized. FIG. 8 shows the experimental results when the pressure chamber L1 is 1.42 mm, and FIG. 9 shows the experimental results when the pressure chamber length L2 is 1.12 mm. In the tables, "narrow" represents the narrow portion width H2, "Ø" represents the nozzle diameter, and the numerical values such as 24 and 22 shown in the upper left corners of the tables are the total numbers of evaluations ○. In the tables, 2.4, 2.8, 3.1, and 3.5 shown on the right side of B/A are values of A, and 0.5 to 2.0 shown below are values of B.

The recording quality was evaluated by recording a specific pattern on the recording sheet of paper and organoleptically evaluating the recorded part. In the tables, ○ represents the evaluation when there are neither shifts of the impact positions of the ink drops nor splashes of ink when ink drops are jetted and it is presumed that normal jetting could be performed, and cases not satisfying the evaluation condition of ○ are all represented as ×.

As shown in FIG. 8, as the narrow portion width H2 increases like 82 μm, 86 μm, and 90 μm, the number of ○ in the areas where the values of A and B are large decreases. This phenomenon is substantially the same when the nozzle diameter is 19.5 μm, 20.5 μm, and 21.5 μm. Moreover, as shown in FIG. 9, when the pressure chamber length is 1.12 mm, the number of ○ in the areas where the values of A and B are large decreases as the narrow portion width H2 increases, and this phenomenon is substantially the same when the nozzle diameter is 16.0 μm, 17.0 μm, and 18.0 μm.

That is, in any of the group of the combinations of the pressure chamber length L1=1.42 mm and the nozzle diameters D=19.5 μm to 21.5 μm and the group of the combinations of the pressure chamber length L2=1.12 mm and the nozzle diameters D=16.0 μm to 18.0 μm, the same driving voltage waveform is used and when the narrow portion width H2 is the same, similar variations in the jetting characteristics are exhibited. In these groups, by using a common ○ part of FIGS. 8 and 9, the narrow portion sizes, that is, the flow passage resistance can be made the same or different.

Effects of the Embodiment (1) As described above, when the inkjet head 30 of the above-described embodiment is used, by setting the flow path resistance of the diaphragm portions 34*b* so as to be substantially the same between the side that jets pigmented ink and the side that jets dye ink and setting the active length L1 so as to be longer on the side that jets pigmented ink than on the side that jets dye ink, the control of the ink drop jetting is not complicated, and the volume of the pigmented ink drops jetted from the nozzles can be made larger than that of the dye ink drops.

(2) Moreover, by making the nozzle diameter of the side that jets pigmented ink larger than that of the side that jets dye ink and setting the flow path resistance of the diaphragm portions determined by the length L2, the width H2, and the depth H1 of the diaphragm portions 34*b* substantially the same between the side that jets pigmented ink and the side that jets dye ink, the nozzle diameter is large as well as the actuator length is large, so that the volume of the pigment ink drops jetted from the nozzles can be made larger.

(3) Further, since the diaphragm portions 34*b* are formed along the flat surface of the supply plate 34, the flow path resistance of the diaphragm portions 34*b* can be easily set to a desired value.

(4) By the structure in which plates are laminated, the nozzles, the common ink chambers, the diaphragm portions, and the pressure chambers can be easily manufactured, and in particular, the diaphragm portions 34*a* having a desired flow path resistance can be easily formed.

(5) When the nozzle diameter and the pressure chamber length of the group that jets pigmented ink are D1 and L1, respectively, and those of the group that jets dye ink are D2 and L2, respectively, an approximate expression $-xD1+yL1 \approx -xD2+yL2$ holds, so that the nozzle diameter D1 can be made larger than the nozzle diameter D2 by adjusting the pressure chamber lengths L1 and L2.

Therefore, when a pigmented ink is the black ink and dye inks are the color inks, since the maximum volume of the ink drops of the black ink can be made larger than that of the color inks, the size of one dot on the medium on which recording is performed can be made the same between black and colors, so that the recording quality can be improved.

(6) Moreover, since the AL value can be made the same in both of the group that jets pigmented ink and the group that jets dye ink, it is unnecessary to use various kinds of driving waveforms, so that the control of the ink drop jetting is not complicated.

(7) Moreover, since there is a correlation expressed by the expression $AL=-xD1+yL1+z \approx -xD2+yL2+z$ (here, x and y are predetermined coefficients, and z is a predetermined constant) among the AL value, the nozzle diameters D1 and D2, and the pressure chamber lengths L1 and L2, when the AL value is a constant value and the nozzle diameter D is changed, the pressure chamber length L to be set can be obtained by substituting the AL value and the nozzle diameter D into the above-described expression.

What is claimed is:

1. An inkjet head, comprising:

a first nozzle that jets pigmented ink;

a first pressure chamber coupled to the first nozzle;

a first actuator that selectively applies a jetting pressure to the pigmented ink in the first pressure chamber;

a second nozzle that jets dye ink;

a second pressure chamber coupled to the second nozzle; and a second actuator that selectively applies a jetting pressure to the dye ink in the second pressure chamber;

wherein the first nozzle has a diameter of D1;

wherein the second nozzle has a diameter of D2;

wherein the first actuator has a first portion that applies the jetting pressure to the first pressure chamber, the first portion having a size of L1;

wherein the second actuator has a second portion that applies the jetting pressure to the second pressure chamber, the second portion having a size of L2; and wherein D1, D2, L1, and L2 satisfy the following formula:

$$-xD1+yL1 \approx -xD2+yL2,$$

where x and y are predetermined coefficients; and wherein $D1 \neq D2$.

2. The inkjet head according to claim 1;

wherein when a time AL is defined as a half of a cycle of a pressure wave caused in the first and second pressure chambers by the jetting pressure, AL satisfies the following formula:

$$AL \approx xD1+yL1+z \approx -xD2+yL2+z,$$

where z is a predetermined constant.

3. The inkjet head according to claim 1;

wherein D1 is larger than D2.

4. The inkjet head according to claim 3;

wherein the first actuator includes a first piezoelectric element and first electrodes sandwiching the first piezoelectric element;

wherein the second actuator includes a second piezoelectric element and second electrodes sandwiching the second piezoelectric element;

wherein the first portion is a part of the first piezoelectric element, the first portion being displaceable by applying a voltage between the first electrodes;

wherein the second portion is a part of the second piezoelectric element, the second portion being displaceable by applying a voltage between the second electrodes; and wherein L1 is larger than L2.

5. The inkjet head according to claim 1;

wherein the pigmented ink includes black ink; and wherein the dye ink includes color ink.

* * * * *